US005956065A

United States Patent [19]

Van den Wijngaert et al.

[11] Patent Number: 5,956,065

[45] Date of Patent: Sep. 21, 1999

[54] PRINTER FOR LARGE FORMAT PRINTING

[75] Inventors: Hilbrand Van den Wijngaert, Grobbendonk; Jacques Leonard, Antwerpen; Guido Desie, Herent; Serge Tavernier, Lint, all of Belgium

[73] Assignee: Agfa-Gevaert, Mortsel, Belgium

[21] Appl. No.: 08/994,092

[22] Filed: Dec. 19, 1997

Related U.S. Application Data

[60] Provisional application No. 60/038,761, Feb. 20, 1997.

[30] Foreign Application Priority Data

Dec. 19, 1996 [EP] European Pat. Off. ..... 96203634

[51] Int. Cl.[6] ..... G03G 15/06; G03G 15/08; G03G 15/09; G03G 15/32

[52] U.S. Cl. ..... 347/158; 347/140; 399/130; 399/222

[58] Field of Search ..... 347/140, 158; 399/130, 222, 252, 265, 267, 279, 289, 299, 302

[56] References Cited

U.S. PATENT DOCUMENTS

| | | | |
|---|---|---|---|
| 4,996,556 | 2/1991 | Gray, Jr. | 355/50 |
| 5,488,397 | 1/1996 | Nguyen et al. | 347/40 |
| 5,552,862 | 9/1996 | Masuda et al. | 355/208 |

FOREIGN PATENT DOCUMENTS

| | | |
|---|---|---|
| 3728493 | 3/1988 | Germany . |
| 19540138 | 12/1996 | Germany . |
| 62-164083 | 7/1987 | Japan . |
| 63-170677 | 7/1988 | Japan . |
| 05011425 | 1/1993 | Japan . |
| 9601489 | 1/1996 | WIPO . |

*Primary Examiner*—Huan Tran
*Attorney, Agent, or Firm*—Baker & Botts, L.L.P.

[57] ABSTRACT

A printer, with printing width (PW) of at least 30 cm printing a toner image on a large substrate, having a width (WS) and a length (LS), including a latent image bearing member having a width (WLI) equal to or larger than the printing width and at least two means for delivering toner are arranged in a staggered configuration around the latent image bearing member and each having a width (WTD) smaller than the width (WLI) of the latent image bearing member.

Preferably the latent image bearing member is a photoconductive member.

A printer with a shuttle having a swath width of at least 30 cm is also disclosed.

7 Claims, 2 Drawing Sheets

PRINTER FOR LARGE FORMAT PRINTING

The application claims the benefit of the U.S. provisional application Ser. No. 60/038,761, filed Feb. 20, 1997.

FIELD OF THE INVENTION

This invention relates to a printing apparatus for large format printing. It relates especially to a large format printer comprising electrophotographic printing devices.

BACKGROUND OF THE INVENTION

In large format printing, e.g. poster printing, billboard printing, wherein the weatherability of the print is very important, silk-screen printing is still a dominant printing method. This method has however its drawbacks. The method is rather time consuming since for every colour a dedicated screen has to be made and printed and the method is basically analog.

More and more images to be printed are available in digital form, so that also in the printing of large formats, digital addressable printing techniques become indispensable.

A well known digital addressable printing technique that is useful for large format printing is ink-jet printing, both with water based inks and with solvent based inks. An example of an ink-jet printer for large format printing can be found in, e.g., U.S. Pat. No. 5,488,397, wherein a printer is disclosed having two or more parallel ink-cartridges shuttling over the width of the substrate to be printed while the substrate moves in a direction basically perpendicular to the direction of movement of the shuttling ink-cartridges.

In WO 96/01489 an ink-jet printer for large format printing is disclosed wherein a single ink-cartridge shuttles over the substrate to be printed.

A commercial ink-jet printer INDANIT 162Ad (trade name) available from Indanit Technologies, Israel, uses multiple ink-jet printheads mounted in a staggered position over the width of the substrate to be printed. In this device the printing substrate has to pass several times under the array of staggered ink-jet printheads while between each pass the printheads are slightly moved in a direction parallel to the width of the substrate. This multi-pass printing enhances the resolution that can be printed, while in the printhead itself the nozzle can be positioned fairly far apart.

Although ink-jet printing provides the possibility for printing large formats in a short time, the possible printing resolution is not always up to the demands, the stability of the image in, e.g., billboards where the image has to be weatherproof leaves still room for improvement.

In the art of printing of large formats, it is however still desired to have still faster printers that use very weatherable marking material, especially toner particles. In toner particles the pigments are imbedded in a resin and thus are the pigments in the image quite well protected from the influences of the environment.

OBJECTS AND SUMMARY OF THE INVENTION

It is an object of the invention to provide a printer for high speed printing of large format images with good resolution.

It is a further object of the present invention to provide a printer, printing large format images with a high printing speed and using dry printing methods and toner particles as marking material.

It is a further object of the invention to provide a printer for printing large format printouts at a high printing speed with good long term stability and reliability.

Further objects and advantages of the invention will become clear from the description hereinafter.

The objects of the invention are realised by providing a printer, with printing width (PW), for printing a toner image on a substrate, having a width (WS) and a length (LS), comprising,

- a latent image bearing member having a width (WLI) equal to or larger than said printing width is present,
- a number n of toner delivery means, each having a width (WTD) smaller than said width (WLI) of said latent image bearing member are present, characterised in that
- said number n is equal to or larger then 2, and
- at least two of said number n of toner delivery means are arranged in a staggered configuration around said latent image bearing member.

Preferably said latent image bearing member is a photoconductive member.

DEFINITIONS

Figure 1:
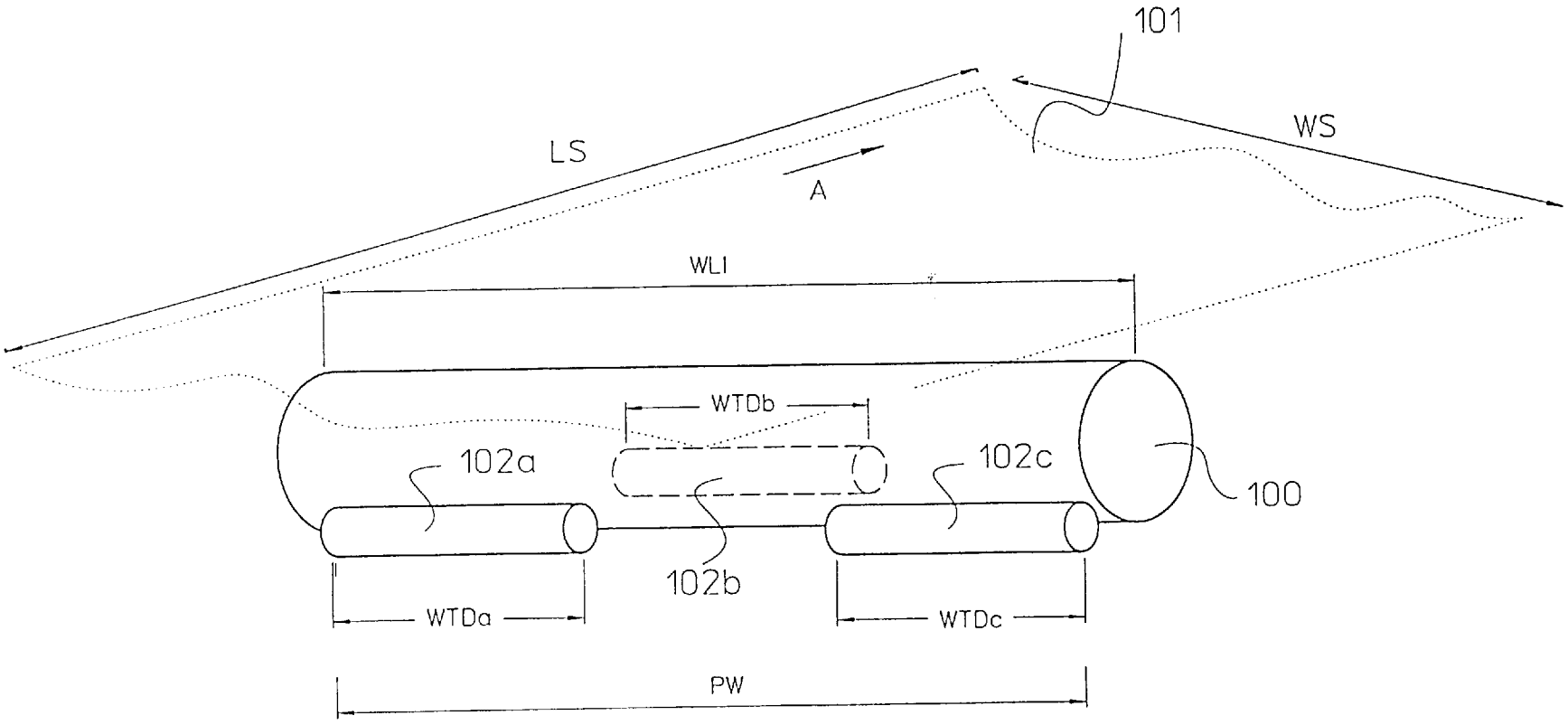
FIG. 1 is a schematic perspective view of a printer according to the first specific embodiment of this invention.

The wording "staggered configuration with respect the latent image bearing member" means that the toner delivery means or the toner applicator modules with a width (WTD) smaller than the printing width (PW) are spread over the width of the latent image bearing member (WLI) so that an image can be printed over the total printing width and that not all the toner delivery means or toner applicator modules are located on a single line.

The wording "toner delivery means" is used to indicate this part of the printing engine carrying toner particles on a surface, from which the toner particles develop the latent image on the latent image bearing member. E.g. the when a magnetic brush is used to bring toner particles on the latent image, this magnetic brush is the "toner delivery means".

The wording "substrate" or "image receiving element" can in this document mean a final image receiving element whereon the toner image is printed, as well as an "intermediate image receiving member" used to accept a toner image and to transfer that image to a final image receiving member.

The width of the image receiving substrate (WS) is the dimension of that substrate that is essentially perpendicular to the direction of movement of the substrate in the printer.

The length of the image receiving substrate (WL) is the dimension of that substrate that is essentially parallel to the direction of movement of the substrate in the printer.

DETAILED DESCRIPTION OF THE INVENTION

It was found that a large format printer (large means in this document a surface of at least 0.25 $m^2$ and an image width of at least 30 cm), could be produced by using in an electrophotographical printing engine at least two toner delivery means having a width (WTD), which were staggered with respect to a latent image bearing member having a width (WLI) equal to or larger than the printing width.

The latent image bearing member can be a magnetic latent image bearing member and then the toner delivery means comprise magnetic toner particles, or said latent image bearing member can be an electrostatic latent image bearing member and then the toner delivery means comprise electrically charged toner particles. Preferably the latent image bearing member is a photoconductive member that is uniformly charged and whereon a latent image is formed by image-wise exposure to light and the toner particles are tribo-electrically charged particles.

A printer according to the present invention, wherein at least two toner applicator modules or at least two toner delivery means are present in a staggered position with respect to a latent image bearing member, can be constructed in such a way that any printing width, from 10 cm up to more than, e.g., 5 meter, can be realised. It is however preferred that the printing width (PW) of a printer according to the present invention is at least 40 cm, more preferably at least 60 cm and, for printing on very large formats, even more preferably 120 cm.

It was found that a photoconductive member, having a width (WLI) larger than 40 cm or larger than 60 cm and evenly chargeable could be manufactured, whereas it proved more difficult, although not impossible, to produce toner delivery means with such a large width wherein all toner particles could be charged to largely the same level. Therefore in a printer according to the present invention, a wide photoconductive member (WLI lager than 40 cm, preferably larger than 60 cm) and toner delivery means of smaller width associated in a staggered configuration with the photoconductive member are used. It proved possible to provide photoconductive members having a width of 120 cm, which is a preferred specific embodiment of this invention for producing a fast printer for very large formats.

In FIG. 1, a perspective view of a printer according to this invention is shown. A photoconductive latent image bearing member (100), having a width WLI, is located under a substrate (101), to be printed, said substrate having a width WS and a length LS. The substrate is for sake of clarity shown as transparent. Around said photoconductive member (100) toner delivery means (102*a, b* and *c*), each having a width (WTDa, b and c) are positioned in a staggered configuration covering printing width PW. Around the photoconductive member also other components of the printer, necessary for the operation of the printer can be located, these are not shown in FIG. 1. The other components can be e.g. charging means to uniformly charge the photoconductor, exposure means, for image-wise exposing the charged photoconductor and cleaning means.

The photoconductive member can comprise an organic photoconductor (OPC) or an inorganic photoconductor, e.g. silicon. The photoconductive member is in FIG. 1 shown as a drum, but it is possible to build a printer according to this invention using a photoconductive member in the form of a belt.

The toner delivery means can comprise magnetic brushes or applicators for non-magnetic mono-component developer. When the toner delivery means are magnetic brushes, both a magnetic brush with stationary core and rotating sleeve and a magnetic brush with a rotating core and stationary or rotating sleeve can be used. When the toner delivery means, in a printer according to this invention, are magnetic brushes, it is preferred, however, to use magnetic brushes with stationary core and rotating sleeve.

The first specific embodiment of the invention also comprises a printer configuration wherein a single intermediate image receiving member with a width equal to or larger than the printing width of the printer is present and at least two latent image bearing members, each associated with a toner delivery means and having a smaller width than the width of the intermediate member are staggered around said intermediate member. Thus, the present invention encompasses also a printer, with printing width (PW), for printing a toner image on a substrate, having a width (WS) and a length (LS),comprising, an intermediate image receiving member having a width equal to or larger than said printing width, a number n of latent image bearing member, each associated with a means for delivering toner particles, and having a width smaller than said width of said intermediate image receiving member, characterised in that: said number n is equal to or larger than 2, and at least two of said number n of latent image bearing members are arranged in a staggered configuration around said intermediate image receiving member.

The toner particles used in a printer, according to this invention, wherein magnetic brushes are used as toner delivery means can be both magnetic toner particles, forming a magnetic mono-component developer and non-magnetic toner particles, forming with magnetic carrier particles and, optionally, further ingredients a multi-component developer. When the printer is intended for colour printing it is preferred that the toner particles used are non-magnetic toner particles. In magnetic toner particles the colouring pigment is combined with a, in most cases, coloured magnetic pigment, this magnetic pigment can deteriorate the hue of the colour pigments and can thus give raise to difficulties in achieving true colour rendition.

When a multi-component developer, comprising magnetic carrier and toner particles, is used, any carrier particle known in the art can be used. The non-magnetic toner particles comprise a toner resin and a pigment or dye and can be of any type known in the art.

The exposure means, to expose a photoconductive member in a printer according to this invention, can be any means known in the art. The exposure can be an analog one, simply projecting the image of an original on the photoconductive member or a digital one. It is preferred to use digitally addressable exposure means, e.g. a laser or an array of light emitting diodes (LEDs). When a laser is used to expose the photoconductive member in a printer according to this invention, the use of a diode laser or semiconductor laser is preferred.

A printer according to the present invention can further comprise any component necessary for the adequate functioning, it can e.g. comprises transfer means (transfer corona) to aid the transfer of the toner particles from the photoconductive member to the substrate to be printed.

A printer according to the present invention can be arranged for printing on substrates in web form as well as for printing on sheets and even on rigid bodies.

In a second specific embodiment of the invention, a combination of a latent image bearing member having a width (WLI) with staggered toner delivery means, as described above, is incorporated in moving shuttle-type printer so that a large format image is written in separate image bands (swaths). The shuttle has preferably a printing width of at least 40 cm, more preferably 120 cm. This means that the latent image bearing member, that is preferably a photoconductive member having a width (WLI) of at least 40 cm. The shuttle, comprising a printer as described in the first specific embodiment of the invention, is travelling over the image receiving member in a first direction, preferably a direction that is essentially parallel to the width of the substrate to be printed and the latent image bearing member is arranged essentially perpendicular to the direction of movement of the shuttle. After having printed a single band over the width of the image receiving member, the image receiving member is moved in a direction different from said first direction, over a distance equal to the printing width of the shuttle. In fact the second specific embodiment of the invention essentially consist of mounting a printer as described in the first specific embodiment of the invention in a shuttle, wherein the printing width of the printer described in the first specific embodiment is essentially parallel to the length of the substrate to be printed and the shuttle moves essentially parallel with the width of the substrate.

This is different from the shuttling printers known in the art while by the second specific embodiment of the invention broader bands can be printed. This means that even with a fairly low shuttling speed of the printer a large format print can be made in a short time. Such a shuttling printer according to the second specific embodiment of this invention can very beneficially be used for printing images of very large dimension (e.g. >5 meter width) with a very high printing speed (e.g. >500 $m^2$/hour).

This second specific embodiment of the invention encompasses thus a printer, for printing a toner image on a substrate, having a width (WS) and a length (LS), comprising means for moving said substrate in a first direction and means for moving a shuttle having a swath width (SWS) in a second direction, different from said first direction, characterised in that said shuttle comprises a latent image bearing member having a width (WLI) equal to or larger than said swath width (SWS) and a number n, equal to or larger than 2, of toner delivery means, each having a width (WTD) smaller than said width (WLI) of said latent image bearing member, at least two of said number n of toner delivery means being arranged in a staggered configuration around said latent image bearing member.

A shuttle according to the present invention can, e.g., comprise a photoconductive member with a width of 120 cm and 4 toner delivery means, each having a width of 30 cm, that are staggered around the photoconductive member and arranged so that the four toner delivery means deliver toner over the whole width of the photoconductive member. Such a printer makes it possible, when the shuttling proceeds with the longest dimension of the shuttling printers (i.e. 120 cm width) essentially perpendicular to the width of the large substrate, to print in one shuttle movement a band that is 120 cm wide. It is clear that such a shuttle can be constructed with wider or smaller latent image bearing members, with more or less toner delivery means, with smaller or larger toner delivery means, etc., without going beyond the scope of the second specific embodiment of this invention.

Also a shuttle comprising a wide intermediate member, whereon smaller electrophotographic units image wise deposit toner particles, as described above is within the scope of the second specific embodiment of the invention. Such a printer comprises means for moving said substrate in a first direction and means for moving a shuttle having a swath width (SWS) in a second direction, different from said first direction, characterised in that said shuttle an intermediate image receiving member having a width equal to or larger than said swath width, a number n, equal to or larger then 2, of latent image bearing member each associated with a means for delivering toner particles and having a width smaller than said width of said intermediate image receiving member, at least two of said number n of latent image bearing members being arranged in a staggered configuration around said intermediate image receiving member.

Figure 2:
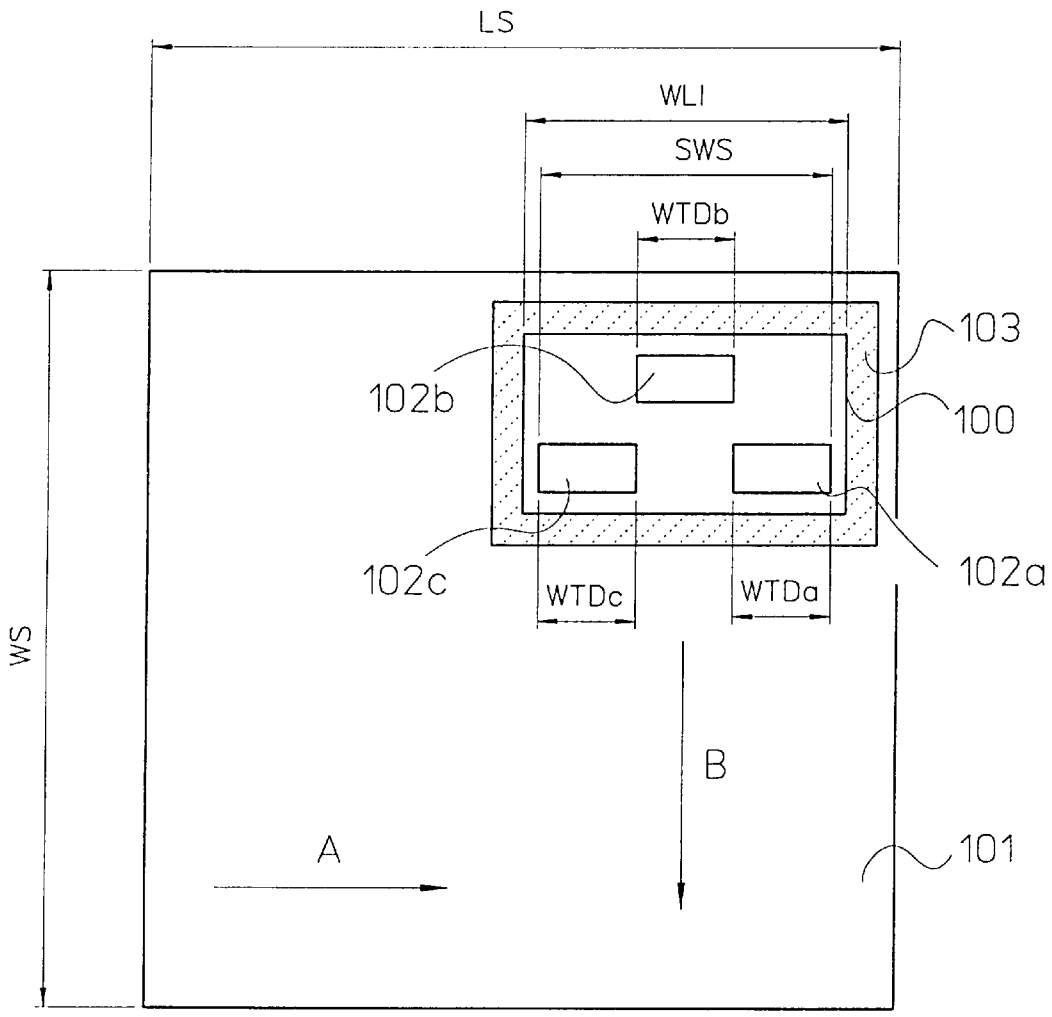
FIG. 2 is a schematic illustration of a printer according to the second specific embodiment of the invention, shown as a projection in the plane of the substrate to be printed.

In FIG. 2, a schematic view of a printer with shuttling printing engines is shown as a projection of the shuttle in the plane of the substrate (101) to be printed. The shuttle (103), comprises a photoconductive drum (100) having a width (WLI), around which 3 toner delivery (102*a, b* and *c*) means, having a width (WTDa, b and c) are located in a staggered position so as to deliver toner particles over the width of the photoconductive member. The swath width of the shuttle corresponds in fact to the width over which the toner delivery means apply toner to the photoconductive member. The shuttle moves over the width (WS) of the substrate to be printed in the direction of arrow B, and after having printed a single band over the width of the image receiving member, the image receiving member is moved in a the direction of arrow A over a length corresponding to the working width (i.e. the width of the band (swath) that can be printed) of the shuttle (103). The shuttle returns in a direction opposite to arrow B and prints the next swath.

We claim:

1. A printer, with printing width (PW), for printing a toner image on a substrate, having a width (WS) and a length (LS), comprising, a member bearing a latent image having a width (WLI) equal to or larger than said printing width, a number n, equal to or larger than 2, of toner delivery means for developing said latent image, each having a width (WTD) smaller than said width (WLI) of said latent image bearing member, at least two of said number n of toner delivery means being arranged in a staggered configuration around said member bearing a latent image.

2. A printer according to claim 1, wherein said printing width is at least 40 cm.

3. A printer according to claim 1, wherein said latent image bearing member is a photoconductive member.

4. A printer according to claim 3, wherein said photoconductive member is in belt form.

5. A printer, with printing width (PW), for printing a toner image on a substrate, having a width (WS) and a length (LS),comprising, an intermediate image receiving member having a width equal to or larger than said printing width, a number n, equal to or larger than 2, of latent image bearing member each associated with a means for delivering toner particles, and having a width smaller than said width of said intermediate image receiving member, at least two of said number n of latent image bearing members being arranged in a staggered configuration around said intermediate image receiving member.

6. A printer, for printing a toner image on a substrate, having a width (WS) and a length (LS), comprising means for moving said substrate in a first direction and means for moving a shuttle having a swath width (SWS) in a second direction, different from said first direction, said shuttle including a latent image bearing member having a width (WLI) equal to or larger than said swath width and a number n, equal to or larger than 2, of toner delivery means, each having a width (WTD) smaller than said width (WLI) of said latent image bearing member, at least two of said number n of toner delivery means being arranged in a staggered configuration around said latent image bearing member.

7. A printer, for printing a toner image on a substrate, having a width (WS) and a length (LS), comprising means for moving said substrate in a first direction and means for moving a shuttle having a swath width (SWS) in a second direction, different from said first direction, said shuttle including an intermediate image receiving member having a width equal to or larger than said printing width, and a number n, equal to or larger then 2, of latent image bearing member each associated with a means for delivering toner particles and having a width smaller than said width of said intermediate image receiving member, at least two of said number n of latent image bearing members being arranged in a staggered configuration around said intermediate image receiving member.

* * * * *